United States Patent [19]

Toma et al.

[11] Patent Number: 4,532,994

[45] Date of Patent: Aug. 6, 1985

[54] WELL WITH SAND CONTROL AND STIMULANT DEFLECTOR

[75] Inventors: Petre Toma; David A. Redford, both of Edmonton; Declan B. Livesey, Calgary; Roy M. Coates, Ardrossan, all of Canada

[73] Assignee: Texaco Canada Resources Ltd., Calgary, Canada

[21] Appl. No.: 517,176

[22] Filed: Jul. 25, 1983

[51] Int. Cl.[3] ..... E21B 43/24

[52] U.S. Cl. ..... 166/303; 166/50; 166/51; 166/278

[58] Field of Search ..... 166/278, 50, 51, 303; 299/2

[56] References Cited

U.S. PATENT DOCUMENTS

| | | | |
|---|---|---|---|
| 2,652,117 | 9/1953 | Arendt et al. | 166/51 |
| 2,980,184 | 4/1961 | Reed | 166/105 |
| 3,999,608 | 12/1976 | Smith | 166/51 |
| 4,116,275 | 9/1978 | Butler et al. | 166/50 |
| 4,368,781 | 1/1983 | Anderson | 166/50 |

*Primary Examiner*—Stephen J. Novosad
*Assistant Examiner*—Michael A. Goodwin
*Attorney, Agent, or Firm*—Robert A. Kulason; Robert B. Burns

[57] ABSTRACT

A well completion and method for improving the productivity of hydrocarbon emulsion from a substrate layer which holds the hydrocarbon. The well completion includes an elongated substantially horizontally disposed liner, the walls of which are perforated to receive the emulsion from the substrate. Operationally, a flow of hot stimulating fluid is injected into the productive layer in a manner to achieve optimum penetration, as well as maximum horizontal sweep thereof. A flowable dam or gravel pack is disposed at the completion remote end and serves to pass a flow of stimulating fluid whereby to achieve the desirable distribution of said stimulating medium into the substrate. However, the gravel pack deters passage of emulsion back into the liner.

7 Claims, 2 Drawing Figures

WELL WITH SAND CONTROL AND STIMULANT DEFLECTOR

BACKGROUND OF THE INVENTION

This invention relates to an apparatus and method therefor, which includes the deep boring into a tar sand's formation for the purpose of extracting hydrocarbon fluids from the earth. More specifically, the invention relates to a method for treating a subterranean formation for the purpose of reducing the viscosity of fluids in the formation, thereby enhancing the extraction of said fluids. The latter is achieve through the use of means to control the movement of solids, along with the hydrocarbon emulsion, which solids would ordinarily impede the extraction process.

The vast majority of heavy oil reservoirs such as tar sands, lie 50 meters under the surface of the earth and therefore must be tapped through the use of in situ technology. Examples of heavy oil reservoirs include those located at the Athabasca and Cold Lake regions of Canada. In the United States the Edna and Sisquoqe are located in California as well as in the tar sand triangle in Utah.

The high viscosity of hydrocarbon and having a density which is between 10 and 20 API, characterize all the above mentioned deposits and substantially all tar sand reservoirs. The heavy oil found in such reservoirs commonly referred to as bitumen, contained in tar sands, is usually immobile at reservoir temperatures.

The particular situation of tar sand reservoirs such as in the Athabasca region of Canada, the reservoir temperature is approximately 7° C. The viscosity of the viscous oil is above 1 million centipoises. In such a condition for all practical purposes, the hydrocarbon is considered as being formed of solid matter.

Another important feature of some tar sand reservoirs is the nature of the solid matrix which is generally comprised of a fine, unconsolidated sand with the median between 100 and 200 μm containing the heavy, viscous oil.

Attempts to recover heavy oil from a tar sand formation have to deal with at least two major problems. These include, the reduction of the oil's viscosity, and the movement of solids such as unconsolidated sands.

One of the most successfully applied practices for recovery of the heavy oil from tar sand is the in situ heating or stimulation thereof.

The efficiency of the heating process is enhanced by the increase of net convection, or the amount of heating fluid which can penetrate the tar sand formation. As a rule, the tar sand's formation is initially saturated with an 80 to 90% high viscosity oil; only 10 to 20% saturated with gases and water.

For most of the tar sand reservoirs and particularly for ones with low and medium temperatures, an initial net convection of the heating fluids into the reservoir cannot be determined. Any increasing of the injection pressure of the heating or stimulating fluid carries with it the likelihood of fracturing the reservoir in an undesirable direction out of the tar sand formation. This circumstance is undesirable since the stimulating fluid will be of no further use.

To control the injection of heating fluids into the formation, it has been proposed to drill inclined and/or horizontally deviated wells. The latter will conduct the heating fluids, and/or additives directly into the heavy oil formation.

The present invention provides an improvement of means for producing from tar sands. It further provides for the cooperative use of injection and production wells in a tar sand formation. Examples of such wells are disclosed in U.S. Pat. No. 3,913,672, J. C. Allen et al; U.S. Pat. No. 3,908, 762, D. A. Redford. In the methods there taught, naturally occurring high permeability breaks or those formed by means of conventional hydraulic fracturing and propping are proposed as a solution for penetrating the tar sand formation.

A diversified, simultaneous injection-production method can be achieved from a single well as disclosed in U.S. Pat. No. 3,913,671, D. A. Redford et al. This latter concept is further disclosed in U.S. Pat. No. 4,088,188, R. H. Widmyer.

In the above described methods, at least one production well is completed to provide a separate path from the surface in order that a treating fluid can be introduced into a portion of an underlying hydrocarbon productive formation. The aqueous heating fluid can be injected into a portion of the formation adjacent to the production well on a timed progress basis. Thereafter, continuous injection of the aqueous heating fluid into the formation can also be utilized.

Toward the further production of heavy hydrocarbons from environments such as tar sands, there are known processes which utilize horizontal or long deviated wells to recover heavy oil from tar sands. These however are subject to at least two major drawbacks. The latter include the control of solids, and the open line bypass affect.

A significant problem is usually encountered when dealing with the production of heavy oil from an unconsolidated formation when a long, horizontal or deviated slotted liner is utilized. Briefly, when the liner penetrates clean sand or shale zones, the control of fine sand particles which are displaced during the recovery process, become a problem.

The fines removed from the formation by the injected produced fluids tend to produce permanent permeability damage by particle plugging. The particles also prompt formation of dunes when they penetrate into a screen or slotted liner.

Another problem encountered in such production relates to the control and tuning of the recovery process when a long inclined or horizontal liner is introduced in the tar sand formation. Injected produced fluids move in and out of the formation radially under the effects of a huff and puff external action and/or under the effect of condensation and flashing during thermal pumping of steam, a method referred to generally as steam stimulation.

Hot water, liquid additives and multiphase fluids that stay far from saturation, are not moved rapidly as easily as steam condensate which is near saturation. The only way to assure optimum penetration of stimulating liquids and/or gases in mixture, is by backing their injection with pressure. This mechanism is, however, less effective than flashing conduction thermal pumping.

In any tar sand substrate, the desired sweeping effect between the injection and production points along a horizontal well is reduced at a negligible fraction since the permeability to flow of an open line is usually many times higher than the permeability of the formation. Therefore, when hot fluids other than steam are injected, the formation around the previously stimulated liner in a cyclic steam injection, is cooled down. This results since only a very small fraction of fluids will be able to penetrate the formation.

The delicate balance between flow of hot stimulating fluid, and heat transfer, will eventually further reduce the actual flow rate into the formation to a very small insignificant area around the slotted perforated liner.

It is found therefore that if the horizontal well is able to radially distribute the injected steam during the stimulation step a reasonable positive sweeping process can be maintained. The long horizontal liner will tend to allow the hot fluids to bypass, thereby overriding the formation during axial flow between the injection and producing points along the liner.

There exists therefore an unfilled need for a system which will make a long horizontal or deviated well, into a more flexible system. Further, the well should be capable of coping with the above stated solids control problem and to better control both axial, and radial inflow-outflow of fluids.

In one embodiment of the presently disclosed invention, a highly deviated, or substantially horizontal wellbore is drilled to penetrate a tar sand formation. The wellbore can extend substantially through the middle of the formation or through another appropriate point. A network of similar deviated wells of identical construction can be drilled into a tar sand field.

The particular spacing of wells and their arrangement will depend to a large degree on the size and the characteristics of the particular formation. One embodiment of the invention provides more than one well which extends through a substrate and which will penetrate the formation at an inclined alignment. Thereafter it can extend in a substantially horizontal disposition through the hydrocarbon production layer.

To overcome the aforementioned problems in producing in a tar sand environment, there is presently provided an elongated, perforated well liner which is registered within a wellbore disposed within the subterranean hydrocarbon producing layer. A well head at one end of the liner permits a pressured introduction of a stimulating fluid to the substrate.

A panel is disposed at the liner remote end wall against which a flowable dam or gravel pack can be inserted and subsequently elongated. The gravel will thus block passage of fluids through at least some of the liner's perforations.

It is an object of the invention therefore to provide an improved means and method for producing hydrocarbon fluids from a substrate that requires thermal stimulation. A further object is to provide a well completion which is capable of providing an efficient sweep of the surrounding substrate by a controlled introduction of stimulating fluid to the latter. A still further object is to provide a well completion in which a flowable, axially expandable barrier is utilized to most effectively distribute a hot stimulating fluid into the substrate whereby to provide a more efficient outflow of a hydrocarbon aqueous emulsion.

Figure 1:
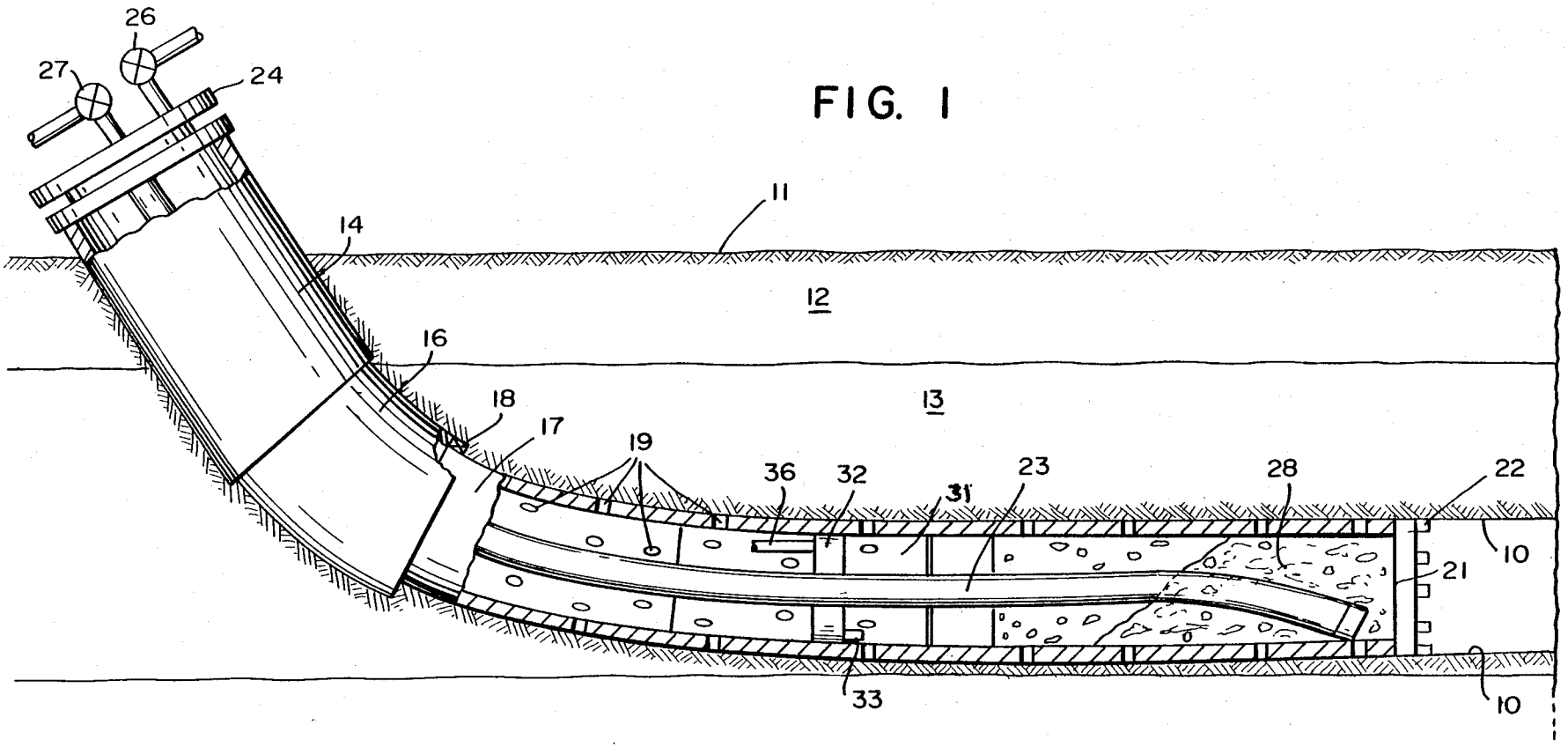
FIG. 1 is an elevation view in partial cross-section of a well of the type contemplated.
Figure 2:
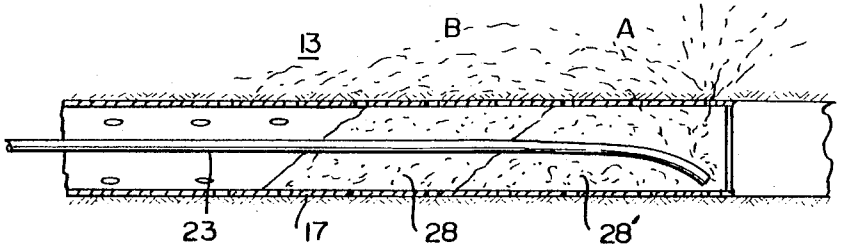
FIG. 2 is a schematic, segmentary view of the well shown in FIG. 1.

In achieving the foregoing objectives, there is presently provided a well completion which is used in a substrate which releasably holds a hydrocarbon fluid. An example of the latter resides in a tar sand type of environment wherein a hydrocarbon such as bitumen is releasably held within a mass of unconsolidated sand particles.

Referring to the drawings, a wellbore 10 of the type contemplated is shown which enters the ground vertically, or preferably at an angle to the surface 11. The wellbore 10 is initially started through the overburden 12 which overlies the productive or tar sand layer 13.

Thereafter, partway through overburden layer 12, bore 10 is deviated in a manner that at least a segment of it lies in a generally horizontal relationship with respect to hydrocarbon productive layer 13, as well as to the earth's surface. Further, the well's horizontal segment is preferably positioned at a depth whereby to be adjacent to the lower border of the generally horizontal layer 13. Following the usual drilling practice, wellbore 10 is provided at its upper end with a series of casing lengths 14 and 16, which are affixed in place by cementing or other means.

An elongated well liner 17 is inserted through the respective casings 14 and 16, and is supported in casing 16 by a liner hanger 18. The latter is structured to permit passage of bitumen emulsion and/or hot stimulating fluid therethrough during the producing or the injection stages of the operation. Liner 17 can be provided at its forward or remote end with means to facilitate its being slidably inserted into and along the wall of wellbore 10.

Structurally, liner 17 comprises a steel, pipe-like member being perforated as required along that portion of its wall which lies within the tar sand layer 13. The perforations can take the form of a series of holes 19 formed through the liner wall. Alternately they can comprise slotted openings which extend either longitudinally or peripherally about the liner. Further, said perforations can be formed either before before or after the liner is placed within the borehole 10.

In any event, liner openings or perforations 19 are adequate to allow the discharge of heating medium therethrough and into the adjacent tar sand containing substrate 13. Further, they allow the return flow or the entry of a hot, aqueous bitumen mixture through the same wall openings after said mixture achieves a flowable state.

In one embodiment, the forward or remote end of liner 17 is provided with a panel or plate 21 which defines a substantial barrier and partial closure to the end of the liner. Said panel means is disposed normal to the longitudinal axis of the liner and fastened in place by peripherally arranged screws, bolts, or other fastening means 22.

An elongated fluid carrying conductor or conduit 23 is disposed internally of liner 17. Said conductor can rest on the liner inner wall or it can be supported by spaced apart stabilizers which attach to the conductor.

Conductor 23 is constructed of continuous tubing or alternately of pipe lengths which are interconnected end to end. Said conduit is capable of carrying a pressurized stream of hot stimulating fluid such as steam, hot water or either of said elements having appropriate chemicals intermixed therewith to facilitate the producing process. The condition of the injected fluid will depend to a large extent on the composition of the substrate 13.

The elongated conductor 23, if supported within the liner 17 defines an annular passage 31 for at least a part of the liner length. It can, however, as noted rest directly on the conductor wall and be supported by the latter.

The upper external ends of the respective liner 17 and conductor 23 are provided with a closure means such as a well head 24. The latter includes regulating valves 26 and 27 which are operable to permit selective and controlled communication of the individual liner passages with a source of stimulating liquid.

To facilitate the efficient stimulation of layer 13 by sweeping a greater area thereof with hot stimulating fluid, liner 17 is provided with a dam or flowable gravel pack 28. Said element is disposed at the remote end of the liner in such manner that it will block a portion of the perforations which open into the substrate layer 13.

Gravel pack 28 as shown, is initially, and subsequently inserted into the well liner for predetermined lengths commencing at end panel 21 and extending toward the liner's production end. A function of this mass of gravel or other particulate material is to regulate the movement of solids from the substrate into the liner.

More specifically gravel pack 28 tends to block the passage of certain sands or fines which are displaced by the moving bitumen emulsion as the latter gravitates toward the lower pressure end of the liner. It further influences movement of stimulating fluid in layer 13.

However, it further permits a radial flow of pressurized, hot stimulating fluid into the substrate at the liner injection end. Thereafter, the gravel pack deters flow of bitumen emulsion into the liner. Thus, the flow paths A established by the stimulating fluid will tend to extend longitudinally along the liner length.

As will hereinafter be noted, after a period of operation either by the sequential thermal stimulation and drawdown process, or by simultaneous stimulation and production process, it will become apparent that the production of bitumen emulsion is decreasing. Gravel pack 28 will then be elongated by adding to the original mass, a second batch of the material 28' which is inserted through the well head 24 and into the horizontal portion of liner 17.

In a producing operation, stimulating fluids such as steam or hot water will be introduced to central conductor 23 from a connection such as valve 27, at well head 24, and the volume regulated by the well head valve. Initially, the entire well and the adjacent substrate of layer 13 are preheated to a desired temperature. This is achieved by the flow of stimulating fluid which is carried the entire length of the conductor and discharged at the remote end thereof, and by the concurrent introduction of pressurized stimulating fluid into the annular passage 31.

The hot pressurized steam will be capable of penetrating the consolidated gravel pack 28, and will pass into layer 13 through the liner perforations 19. The normal flow of such stimulant, due to its elevated temperature will be upwardly through the substrate and toward the surface.

Due to the pressure build-up in response to entry of the 300 to 400 psi steam, the latter will tend to heat the retained bitumen in layer 13, cause it to melt and thereby form passages or paths A through the layer. The interior of liner 17 will be maintained at a relatively low pressure compared to the pressure of the stimulant, the flowing bitumen emulsion will thus gravitate toward liner producing end of the liner.

Thereafter the flowing bitumen emulsion will enter the liner itself and be conducted to the surface by a pump or similar means disposed within the liner.

In one embodiment, and to add to the efficiency of the disclosed method and apparatus, the means for extracting hot bitumen emulsion from the liner, includes a pump 32 which can be movably positioned in liner 17. Said pump includes an inlet 33 which is arranged to receive the hot bitumen soltuion, and a pump discharge 34 which connects to a conduit 36 whereby to convey the hot emulsion to well head 24.

As gravel pack 28 is progressively added to, pump 32 can be retracted along the liner or positioned as required to effectuate the lengthening of the gravel pack as well as to remove the collected bitumen emulsion.

Operationally, the well can function on a huff and puff sequence or it can function continuously by injecting stimulating fluid as noted whereby the flow of emulsion will move toward the liner lower pressure end. In any event after a period of operation it will become apparent that the paths A which are formed in layer 13 by movement of the hot emulsion, will become depleted of bitumen. The production of product at the well head 24 will decrease and the presence of discharging steam at well head 24 will be noticeably increased. This circumstance indicates that entering stimulating fluid is no longer melting bitumen but merely adopting the easiest flow path toward the low pressure section of the liner.

At this point in the operation, and to elongate and adjust the flow paths A and B through layer 13, the internal gravel pack 28 is expanded by introducing an additional length 28' thereof. This as shown in the FIG. 3 will merely be a continuation of the original pack but positioned within the annulus 31 defined by conductor 23 and the liner 17 inner wall such that a greater number of the liner perforations 19 will be covered.

With the extended gravel pack 28 and 28' in place, the introduction of pressurized stimulating steam through the central conductor is continued. The latter will enter substrate layer 13, and rather than following the (A) paths previously formed by the stimulating injection, will be forced to adopt a new set of paths (B) such that the melted bitumen which is unable to enter the liner 17 through the previous perforations, will be forced to enter perforations closer to well head 24.

Thereafter as the flow of stimulant is continued into the substrate, the new paths B formed therethrough will allow the bitumen emulsion access to liner 17, which bitumen has been extracted from an area of layer 13 that has not been heretofore stimulated.

Over a period of time as the producing operation is continued, gravel pack 28 is progressively extended. Eventually the latter will approach the upper level of the productive layer 13 so that further stimulation will not add to the volume of emulsion produced.

To function effectively, the sizes of the agglomerated particles which make up gravel pack 28 are such that the majority of the gravel particles will not pass through perforations 19 in the liner wall. Thus, the respective gravel pack extensions commencing with extension 28', are introduced sequentially to the liner by way of well head 24 in the form of a slurry, a gel or the like.

Preferably the gravel slurry is carried through liner 17 in a slug such that it will abut, and form extension 28' to the previously positioned pack 28. Excessive fluid which carries the slurry slag will pass through perforation 19 into the adjacent substrate, this flamable carrier material can also be pumped from the liner as it accumulates.

It is understood that although modifications and variations of the invention can be made without departing from the spirit and scope thereof, only such limitations should be imposed as are indicated in the appended claims.

We claim:

1. A well completion for producing hydrocarbons from a tar sand layer comprised of unconsolidated sand particles in which the hydrocarbon is releasably held, which well completion is registered within a wellbore disposed in a generally horizontal disposition along said tar sand layer, and including;

an elongated well liner having a perforated wall which is capable of transmitting a stream of hot stimulating fluid in one direction therethrough to penetrate said tar sand layer, and a flow of hydrocarbon emulsion together with unconsolidated sand particles in a reverse direction through the wall and into the liner, a well head at the upper end of said elongated well liner, and a transverse panel at the liner remote end forming at least a partial closure thereto, a conductor depending from said well head and extending longitudinally of said liner and terminating in a discharge port adjacent to said panel, and means forming a longitudinally extendable gravel pack comprised of a mass of unconsolidated particulate matter disposed at the liner remote end to substantially cover at least some of the perforations therein and to deter inward flow of hydrocarbon emulsion and unconsolidated particulate matter into the liner through said covered perforations.

2. In a well completion as defined in claim 1, wherein said means forming said gravel pack includes;

an annular mass which extends from said transverse panel in a direction toward the well head.

3. In a well completion as defined in claim 1, wherein said means forming said gravel pack includes;

a mass of unconsolidated earthen material which is pervious to the flow of the stimulating fluid.

4. In a well completion as defined in claim 1, wherein said flowable mass of said particulate matter is comprised primarily of particles having a size which is incapable of passing through the liner wall perforations.

5. In a well completion as defined in claim 1, including a pump means disposed in said liner adjacent to the gravel pack.

6. Method for producing bitumen emulsion by thermal stimulation of a subterranean formation comprised of a tar sand layer, which method includes the steps of;

forming a wellbore having a portion which extends through said tar sand layer in a generally horizontal direction, inserting a perforated wall well liner having a remote end and production end, into the wellbore, said liner including a conductor which extends substantially the length thereof and is adapted to communicate with a pressurized source of a thermal stimulating fluid, forming a gravel pack in the said liner remote end to define an unconsolidated mass of particulate matter which covers a portion of the liner wall perforations for a predetermined distance extending from the liner remote end toward the production end thereof to prevent the flow of hydrocarbon emulsion into the liner through said covered portion of the perforations, introducing a stream of said thermal stimulating fluid by way of said conductor into the substrate adjacent to said well liner whereby to establish a flowable bitumen emulsion, and recovering said bitumen emulsion from the well liner production end.

7. In the method as defined in claim 6, including; the step of introducing additional particulate matter to said liner to extend the gravel pack length toward the production end thereof, whereby to cover additional liner perforations and cause said bitumen emulsion to enter only uncovered perforations at the liner production end.

* * * * *